US007760081B2

(12) United States Patent
Eiden et al.

(10) Patent No.: US 7,760,081 B2
(45) Date of Patent: Jul. 20, 2010

(54) IMPLICIT DATA BACKUP AND RESTORAL SYSTEM IN A PEER-TO-PEER FIRE DETECTION NETWORK

(75) Inventors: Karl Eiden, Moticello, MN (US); Glenn Wontorcik, Corcoran, MN (US)

(73) Assignee: Honeywell International Inc., Morristown, NJ (US)

( * ) Notice: Subject to any disclaimer, the term of this patent is extended or adjusted under 35 U.S.C. 154(b) by 330 days.

(21) Appl. No.: 12/101,795

(22) Filed: Apr. 11, 2008

(65) Prior Publication Data

US 2009/0256712 A1 Oct. 15, 2009

(51) Int. Cl.
*G08B 29/00* (2006.01)

(52) U.S. Cl. ..... 340/506; 340/522; 340/524; 340/525; 340/531; 340/628; 439/485; 439/692; 439/948

(58) Field of Classification Search ..... 340/506, 340/522, 524, 525, 531, 628; 439/485, 692, 439/948

See application file for complete search history.

(56) References Cited

U.S. PATENT DOCUMENTS

| | | | | |
|---|---|---|---|---|
| 5,483,222 | A | 1/1996 | Tice | |
| 5,798,701 | A * | 8/1998 | Bernal et al. | 340/628 |
| 6,163,263 | A | 12/2000 | Tice et al. | |
| 6,353,395 | B1 * | 3/2002 | Duran | 340/691.1 |

* cited by examiner

*Primary Examiner*—Tai T Nguyen
(74) *Attorney, Agent, or Firm*—Husch Blackwell Sanders Welsh & Katz

(57) ABSTRACT

A fire detection network employs an implicit data backup and recovery system. The implicit data backup system allows fire detection units within a network to be automatically reprogrammed with configuration data. The detection units can store backup data and can access the stored backup data when necessary.

20 Claims, 9 Drawing Sheets

IMPLICIT DATA BACKUP AND RESTORAL SYSTEM IN A PEER-TO-PEER FIRE DETECTION NETWORK

FIELD OF INVENTION

The present invention relates generally to fire detection networks. More particularly, the present invention relates to fire detection units or panels within a network that employ an implicit data backup system. The data backup system stores backup data and can access the stored backup data when necessary.

BACKGROUND

Fire detection networks are commonly used in business settings to protect life, safety, and property. A fire detection network can include one or more individual detection or monitoring units or panels. Each detection or monitoring unit can operate as an individual system. Alternatively, multiple fire detection units can be networked together to form a larger detection or monitoring system. Fire detection networks can be installed in large facilities or multiple buildings, such as campus-type environments.

Examples of fire detection systems are found in U.S. Pat. No. 5,483,222 to Tice entitled "Multiple Sensor Apparatus and Method" and U.S. Pat. No. 6,163,263 to Tice et al. entitled "Circuitry for Electrical Device in Multi-Device Communications System", which are assigned to the assignee hereof. Both U.S. Pat. No. 5,483,222 and U.S. Pat. No. 6,163,263 are hereby incorporated by reference.

In peer-to-peer fire detection networks, each fire detection unit or panel within the network contains a unique set of operating parameters or configuration data. These parameters are defined by an installer based on the particular operating characteristics required for a given installation. Typically, a configuration utility, resident on a personal computer (PC), is used to configure the network. Then, the configuration data is transferred from the PC to the units within the network.

The environments in which fire detection networks are deployed are often harsh. Detection units can be placed in unconditioned environments and be connected to miles of field wiring. During the life of a fire detection unit, fire detection equipment can become damaged or otherwise rendered inoperable through water damage, lightening, power line surges, and like. When such damage occurs to a unit, the unit requires replacement and must be reprogrammed to once again operate as part of the network.

When it becomes necessary to replace a detection unit or panel, a new unit must be physically installed to take the place of the old unit. The physical replacement of a unit typically involves only the disconnection of field wiring, swapping in the replacement panel, and restoring connections to field wiring. However, once physically installed, the replacement unit must be reprogrammed using the PC-based configuration utility, as described above, in order to obtain full functionality.

While the physical replacement of a fire detection unit can be accomplished without intimate knowledge of the fire detection network, reprogramming a replacement unit can be more difficult. Traditionally, reprogramming a replacement unit has been done manually. Reprogramming a unit or panel can require specialty tools, software, expertise, and access to the latest configuration data. Furthermore, the reprogramming process can be time consuming and prone to errors.

There is thus a continuing, ongoing need for a fire detection network that employs an implicit data backup and recovery system. The implicit data backup system should allow fire detection units within a network to be automatically reprogrammed with configuration data. Preferably, the units can store backup data and can access the stored backup data when necessary.

BRIEF DESCRIPTION OF THE DRAWINGS

FIG. 6 illustrates a fire detection network in accordance with the present invention in which a replacement unit has been installed;

DESCRIPTION OF THE PREFERRED EMBODIMENTS

Figure 1:
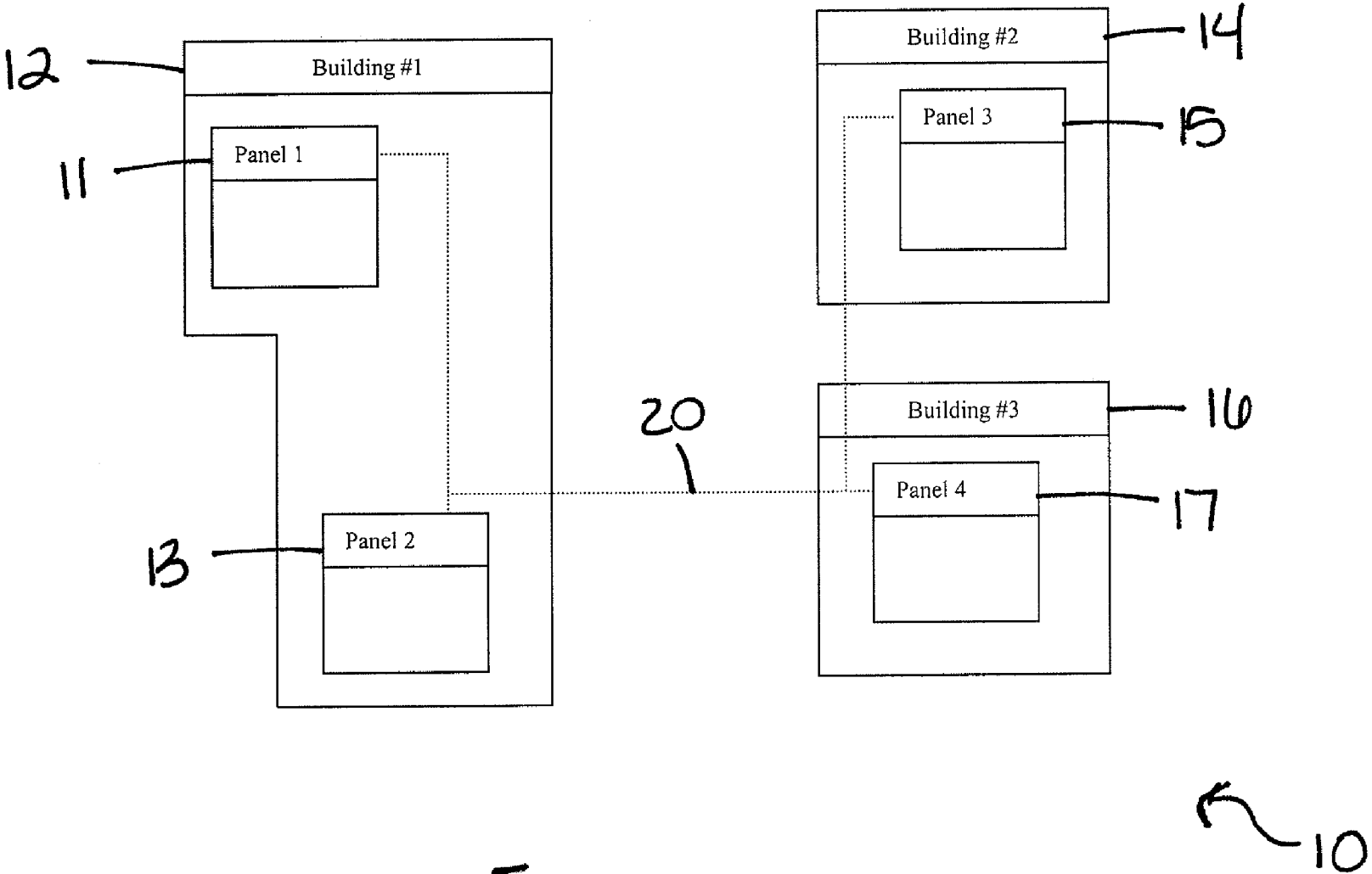
FIG. 1 illustrates a fire detection network in accordance with the present invention before configuration data is downloaded onto each unit.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments of the present invention include a fire detection network that employs an implicit data backup and recovery system. The implicit data backup system allows fire detection units within a network to be automatically reprogrammed with configuration data. In preferred embodiments, the units can store backup data and can access the stored backup data when necessary.

When fire detection units or panels are incorporated into a fire detection network, it is still necessary for each unit to contain specific and unique configuration data. Such configuration data can describe the physical setup of each unit, how each detection unit is configured, how each detection unit is to react to network events, and what peripheral devices or equipment is attached to each unit.

A system architect can use a computer-based tool to design the details of a fire detection network in accordance with the present invention. After the design phase, a system architect or installer can download operating parameters to individual units within the network. Once configuration data has been downloaded to each unit, the units can begin operation.

To download configuration data, an installer can connect a personal computer (PC) to one of the detection units within the network. The configuration data for each unit within the network can be downloaded from the PC to each of the units. Once downloaded, the units can begin to utilize the newly downloaded data and begin operation.

In embodiments of the present invention, after the detection units within the network begin operation, an implicit data backup and recovery system can be employed. The implicit data backup and recovery system can include two primary components: storing backup data and accessing the stored backup data when necessary. Backup copies of configuration data for units within the network can be stored on other units within the network.

While performing normal fire detection functions, the units can automatically distribute backup copies of their configuration data to other units within the network. This distribution can continue until at least one other unit has a backup copy of the configuration data for each unit within the network. Alternatively, this distribution can continue until each unit has backup copies of the configuration data for every other unit within the network. In embodiments of the present invention, the configuration data can be stored and accessed when necessary.

In embodiments of the present invention, a backup or duplicate copy of the operational parameters or configuration data of each detection unit in the network is maintained. The backup copy can be used as the data source for restoring the operational parameters should a detection unit be replaced in the future.

In one embodiment of the present invention, each detection unit within a network can maintain a backup copy of configuration data for at least one other unit within the network. That is, each unit within the network can maintain configuration data for itself and for at least one other unit within the network. In this embodiment, if any single unit requires replacement, an image of its configuration data can survive and be available for transfer to the replacement unit.

In an alternative embodiment, each detection unit within a network can maintain backup copies of configuration data for all other units within the network. In this embodiment, an entire network can be easily recovered with only one unit. That is, if all of the units within a network are replaced except for one surviving unit, the entire network can be recovered. Each replacement panel can simply retrieve its configuration data from the backup copy stored on the surviving unit.

In embodiments of the present invention, the backup data stored on each unit can be stored in a compressed format. Maintaining the backup data in a compressed format maximizes the number of units for which backup data can be stored because the amount of memory space consumed is minimized. The compressed format of the backup data further facilitates each unit within the network storing copies of the configuration data for all of the other units within the network because less memory space is consumed.

The backup system in accordance with the present invention is an implicit backup system. That is, backup copies of configuration data will be distributed and stored automatically and without any user intervention. A user or installation technician has no need to know how and where backup copies are located. Further, if changes are made to configuration data anywhere on the network, any and all backup copies will be automatically updated without user intervention.

In embodiments of the present invention, the fire detection network maintains complete functionality during the distribution of backup copies between and among the various units within the network.

The implicit backup and recovery system allows for the stored configuration data to be accessed when necessary. When a replacement unit or panel is installed within a fire detection network, it will not contain any configuration data. Once the replacement unit has been physically installed into the network and power has been applied to the unit, the remaining units within the network will begin communicating with the replacement unit.

An installer or technician can use a graphical user interface located on or associated with either the replacement unit or one of the remaining units in the network to direct the system to transfer backup configuration data associated with the replacement unit to the replacement unit. Once the replacement panel receives its configuration data, it will be fully functional, and operation of the fire detection network will be fully restored.

FIG. 1 illustrates a fire detection network in accordance with the present invention before configuration data is downloaded onto each unit. As can be seen in FIG. 1, a fire detection network 10 can be installed in various buildings 12, 14, 16. Each building can contain one or more fire detection units or panels 11, 13, 15, 17. The units 11, 13, 15, 17 can be in communication with one another via communication media 20.

It is to be understood that the number of buildings and the number of fire detection units included in the fire detection network are not limitations of the present invention. The number of buildings associated with the network could be more or less than the number shown in FIG. 1. Similarly, the number of detection units located within each building could be more or less than the number shown in FIG. 1.

The fire detection units 11, 13, 15, 17 can be in wired or wireless communication with one another, or a combination of wired and wireless, as would be understood by those of ordinary skill in the art. Therefore, the communication media 20 as seen in FIG. 1 could be wired, wireless, or a combination of wired and wireless.

As can be seen in FIG. 1, when fire detection units or panels are initially incorporated into a fire detection network, the units do not contain configuration data or operating parameters.

Figure 9:
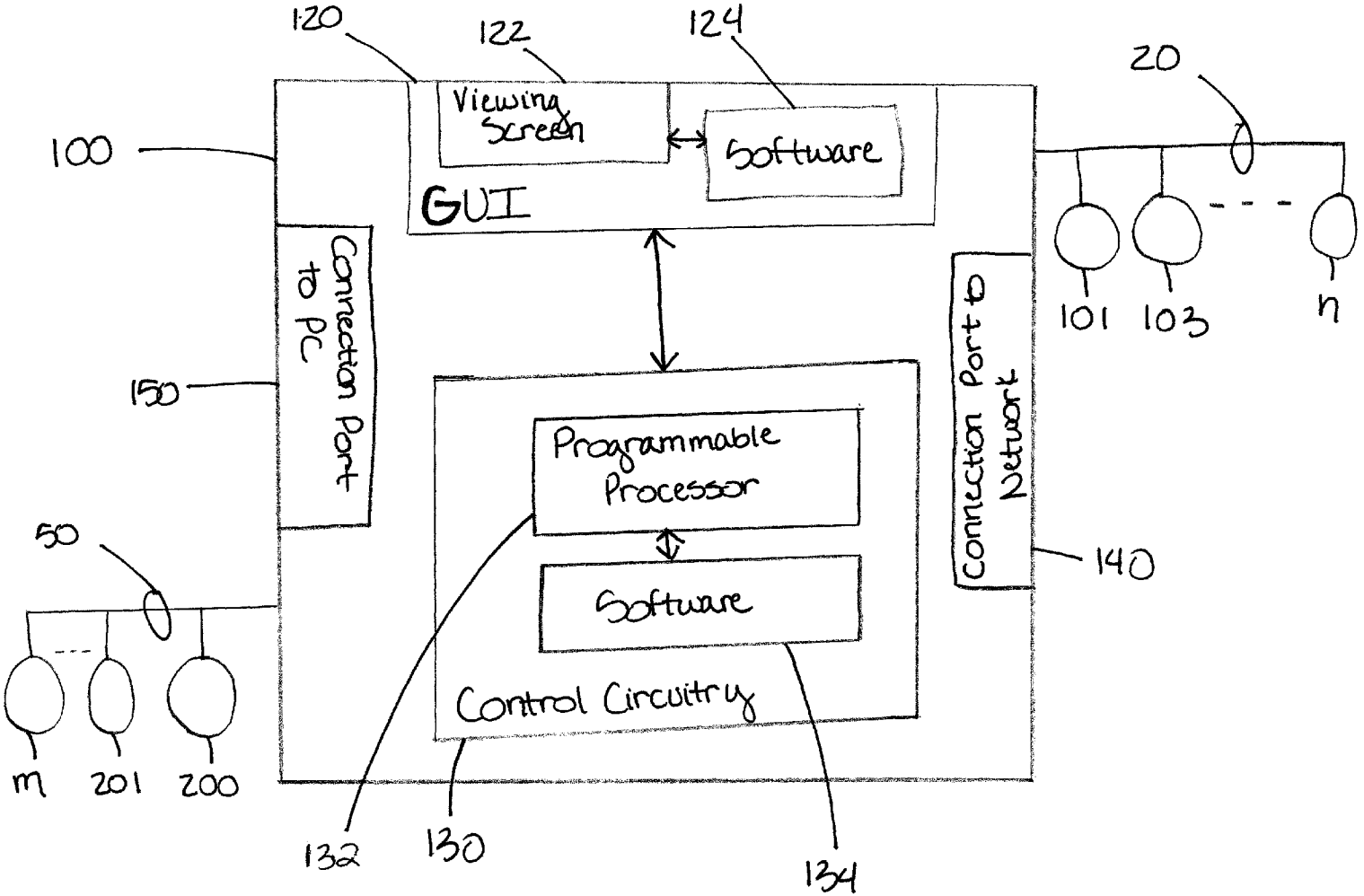
FIG. 9 illustrates a fire detection unit or panel in accordance with the present invention.

FIG. 9 illustrates a fire detection unit or panel in accordance with the present invention. As can be seen in the exemplary embodiment of FIG. 9, a fire detection unit or panel 100 can include a graphical user interface 120 and control circuitry 130, which can be in communication with one another. The control circuitry can further include a programmable processor 132 and associated software 134. The graphical user interface 120 can further include a viewing screen 122 and software 124 as would be understood by those of skill in the art. The graphical user interface 120 can be on or associated with the unit 100 as would be understood by those of skill in the art.

The fire detection unit 100 can also include a connection port 140 to the wired or wireless communication media 20. The communication media 20 can connect the unit 100 with the other units 101, 103 . . . n within the network 10. The fire detection unit 100 can also include a connection port 150 to communication media connecting the unit 100 to a PC. Further, the fire detection unit 100 can be connected to a plurality of fire or smoke detectors 200, 201 . . . m associated with that unit 100 via communication media 50. Communication media 50 can be wired or wireless, or a combination of wired and wireless, as would be understood by one having ordinary skill in the art.

Figure 2:
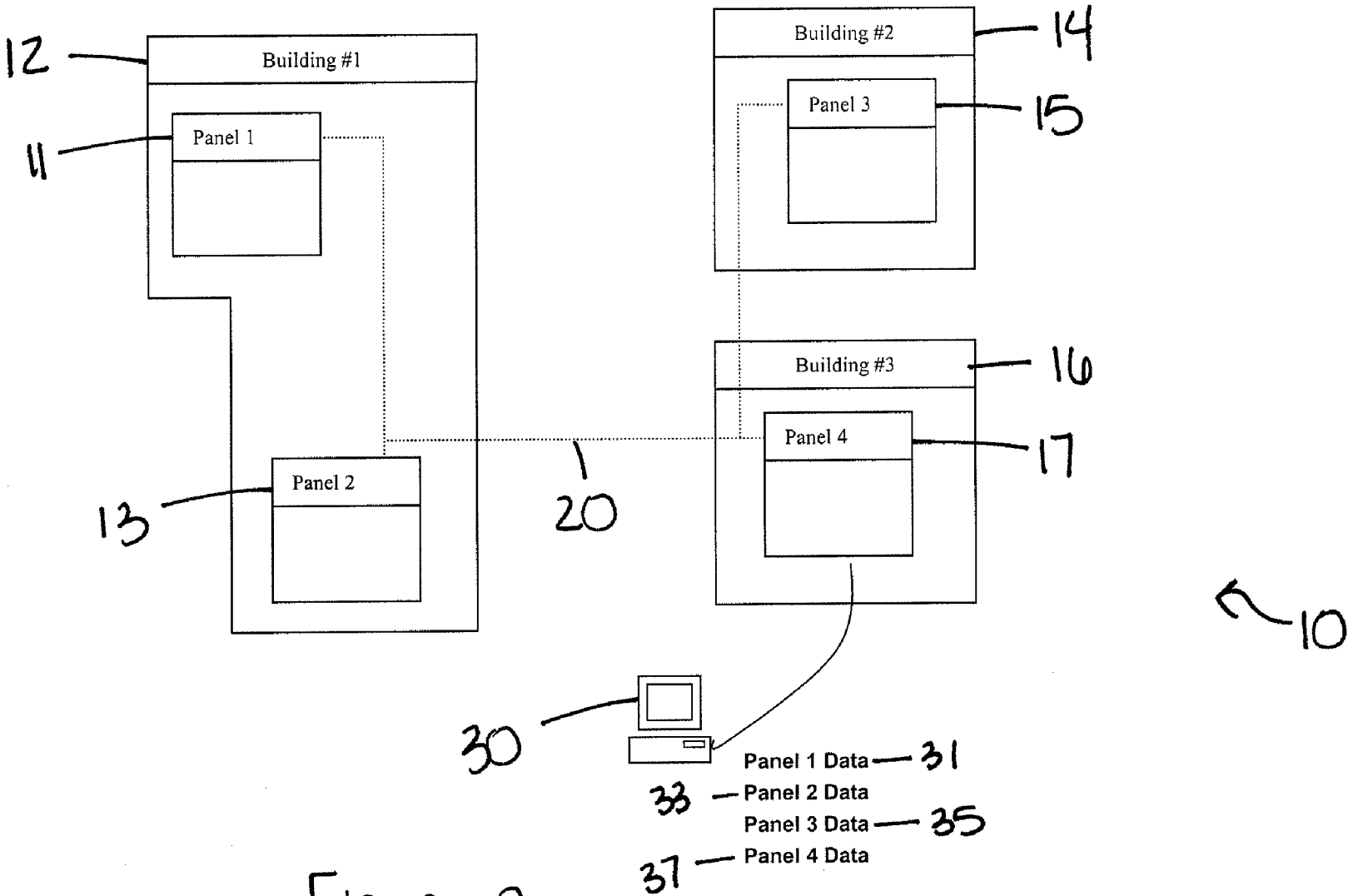
FIG. 2 illustrates a fire detection network in accordance with the present invention employing a personal computer containing configuration data.

FIG. 2 illustrates a fire detection network in accordance with the present invention incorporating a personal computer containing configuration data. As can be seen in FIG. 2, a personal computer (PC) 30 can be connected to the network 10. For example, the PC 30 can be connected to any one of the units 11, 13, 15, 17 in the network 10 via, for example, a connection port 150. In the exemplary embodiment shown in FIG. 2, the PC 30 is connected to the unit 17.

The PC 30 can contain the configuration data or operating parameters 31, 33, 35, 37 for each of the units within the network. The data 31, 33, 35, 37 for each unit 11, 13, 15, 17 is downloaded from the PC 30 to each of the units 11, 13, 15, 17. Each unit 11, 13, 15, 17 can store its configuration data 31, 33, 35, 37 in its associated control circuitry.

In one embodiment of the present invention, the PC 30 is connected to each unit 11, 13, 15, 17 individually to download data associated with that unit 31, 33, 35, 37, respectively. In an alternative embodiment, the PC 30 is connected to one unit, for example, unit 17, and all of the data 31, 33, 35, 37 is downloaded onto the connected unit 17. The connected unit 17 then transfers the downloaded data 31, 33, 35, 37 to the other units 11, 13, 15 in the network.

Figure 3:
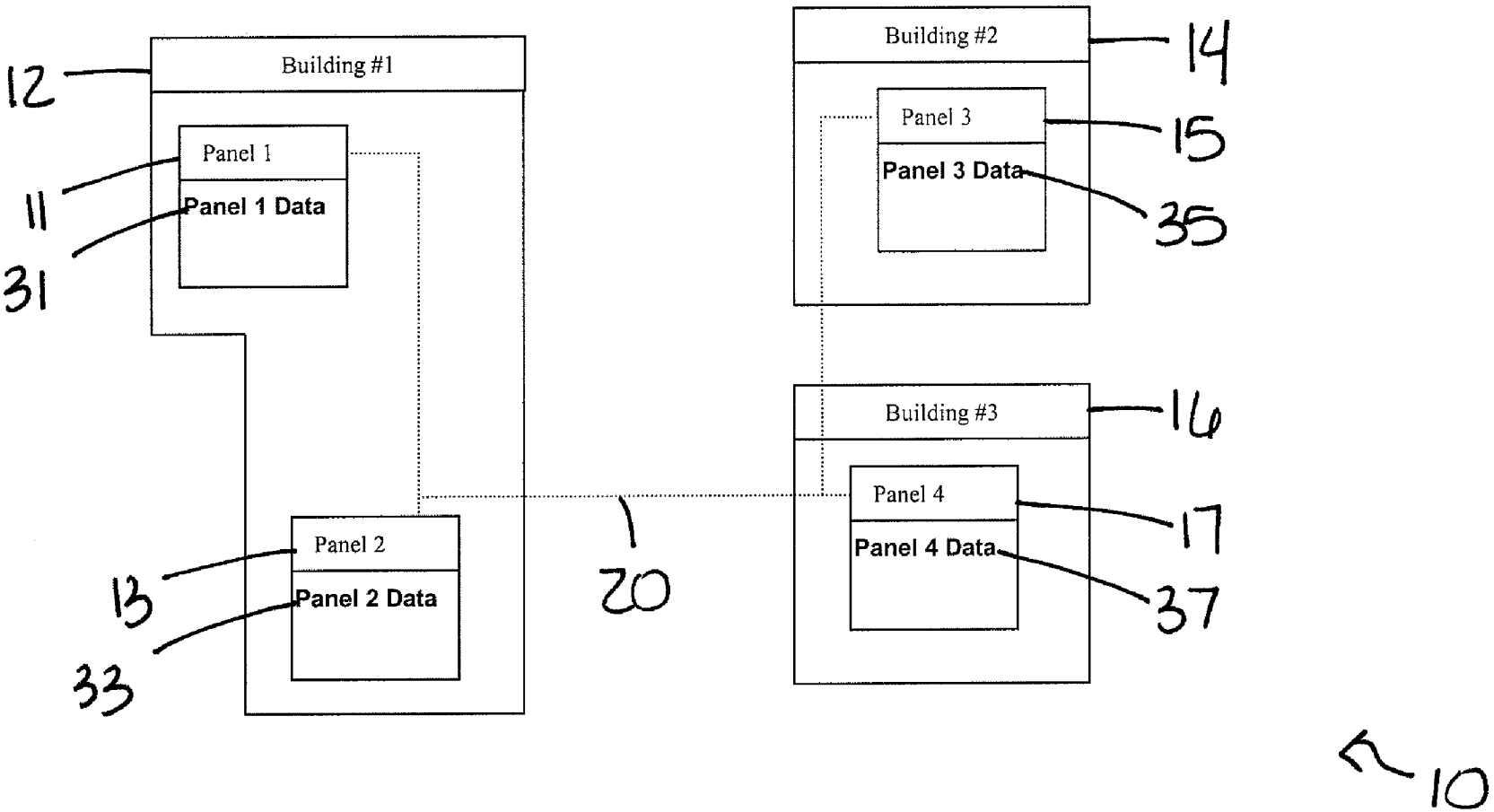
FIG. 3 illustrates a fire detection network in accordance with the present invention employing fire detection units that contain configuration data.

FIG. 3 illustrates a fire detection network in accordance with the present invention employing fire detection units that contain configuration data. As can be seen in FIG. 3, each unit 11, 13, 15, 17 contains its respective configuration data 31, 33, 35, 37. After the configuration data or operational parameters 31 33, 35, 37 are downloaded onto each unit 11, 13, 15, 17 in the network, the units 11, 13, 15, 17 can begin to utilize the data 31, 33, 35, 37 and begin operation.

Figure 4:
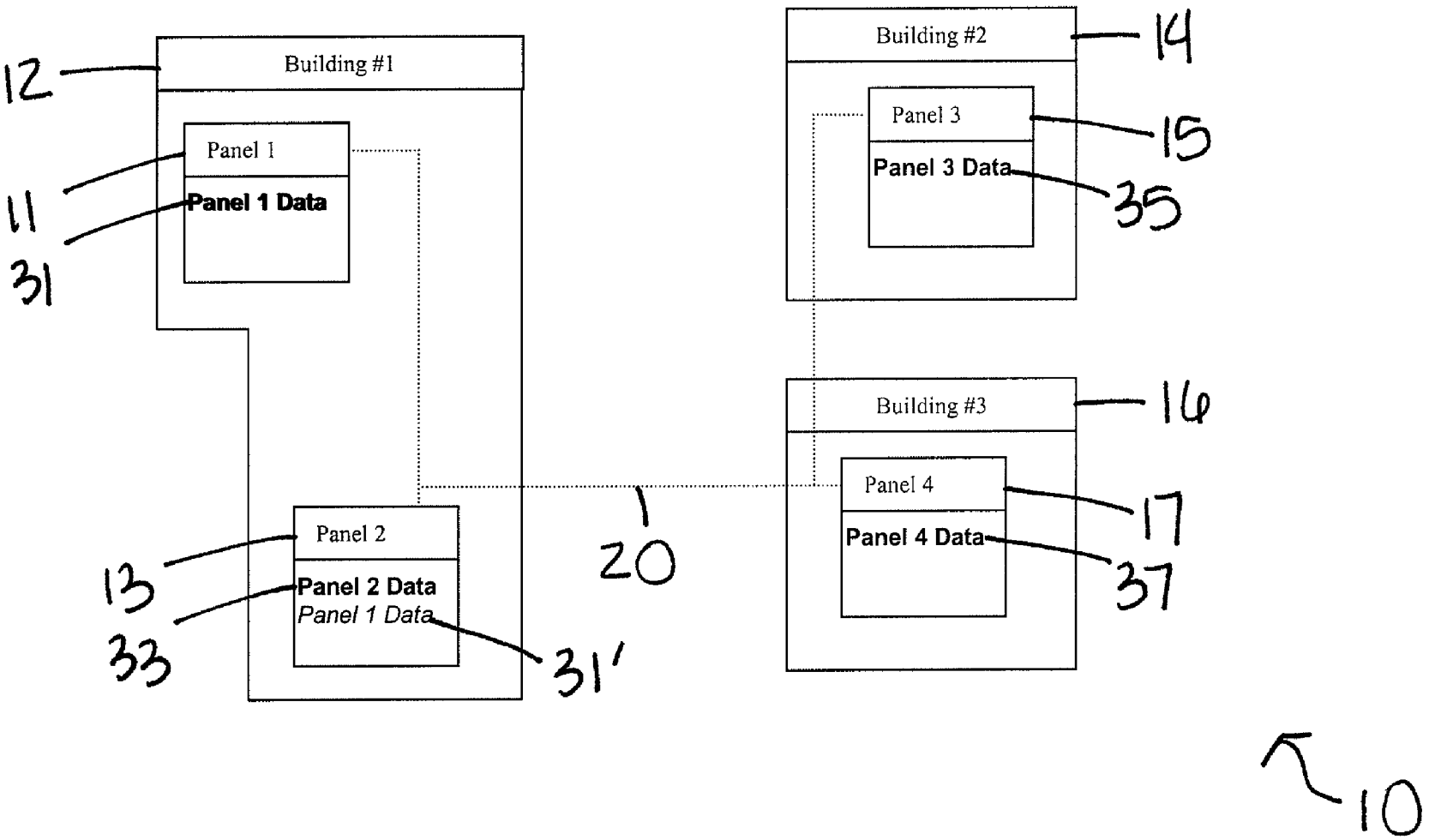
FIG. 4 illustrates a fire detection network in accordance with the present invention employing an implicit data backup system.

FIG. 4 illustrates a fire detection network in accordance with the present invention employing an implicit data backup system. As can be seen in FIG. 4, the fire detection units 11, 13, 15, 17 within the network 10 can distribute backup copies of their configuration data 31, 33, 35, 37 to other units 11, 13, 15, 17 within the network 10. Each unit 11, 13, 15, 17 can store backup copies of the configuration data 31 33, 35, 37 for other units 11, 13, 15, 17 in its own associated control circuitry.

In the exemplary embodiment shown in FIG. 4, unit 11 has distributed a backup copy 31' of its configuration data 31 to unit 13. Once the unit 13 stores the back up copy 31', the backup copy 31' can be used as a data source for restoring the configuration data 31 should unit 11 be replaced in the future.

The implicit data back up system illustrated in FIG. 4 can continue until at least one other unit has a backup copy of the configuration data for each unit in the network. That is, the implicit data backup system can continue until, for example, unit 13 has a backup copy 31' of the configuration data 31 of unit 11, unit 15 has a backup copy 33' of the configuration data 33 of unit 13, unit 17 has a backup copy 35' of the configuration data 35 of unit 15, and unit 11 has a backup copy 37' of the configuration data 37 of unit 17. It is to be understood the above is merely exemplary, and each unit 11, 13, 15, 17 can store a backup copy 31', 33', 35', 37' of the configuration data 31, 33, 35, 37 of any unit 11, 13, 15, 17 in the network 10.

Figure 5:
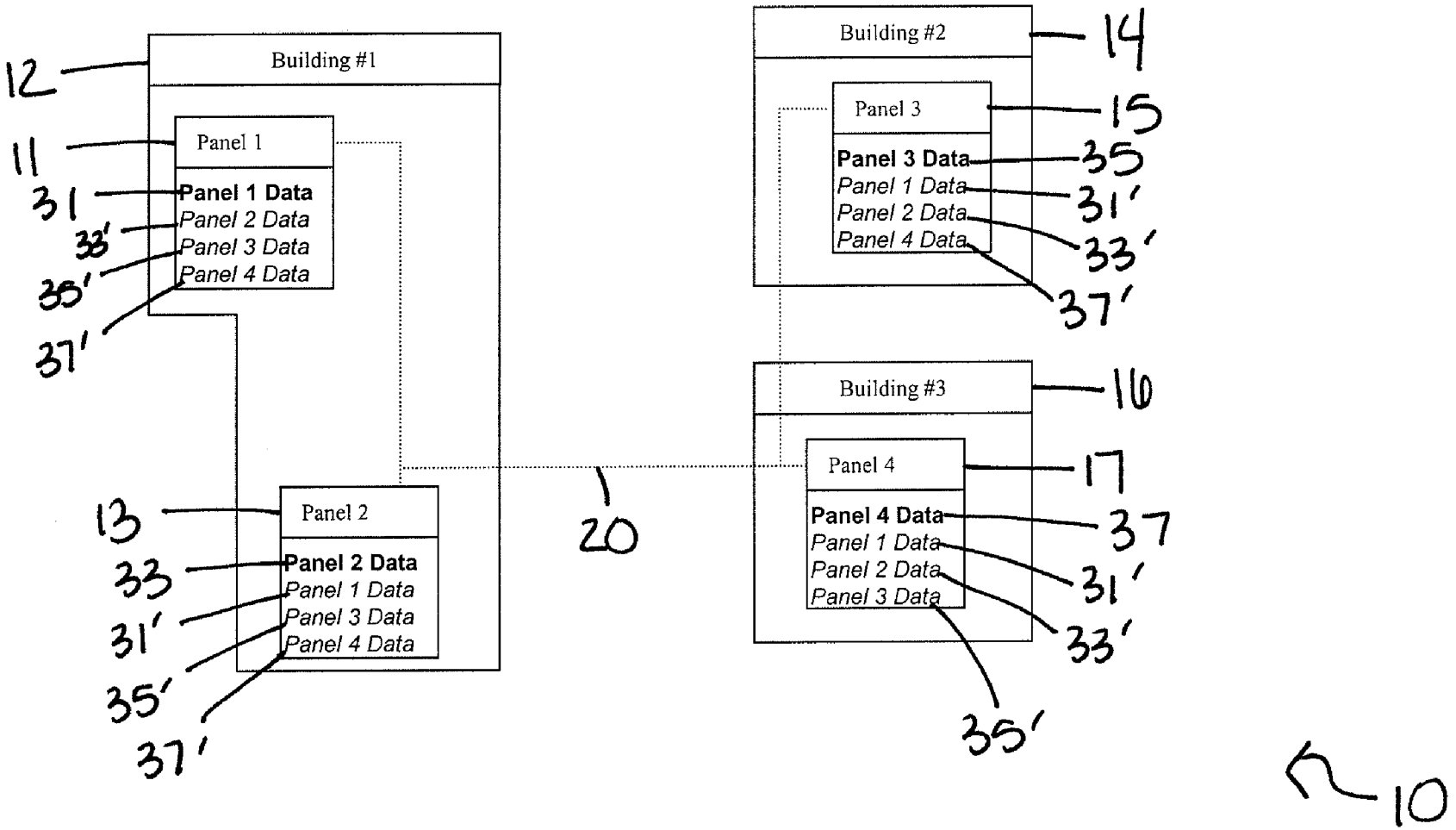
FIG. 5 illustrates a fire detection network in accordance with the present invention in which each unit has backup copies of the configuration data for every other unit within the network.
Figure 4:
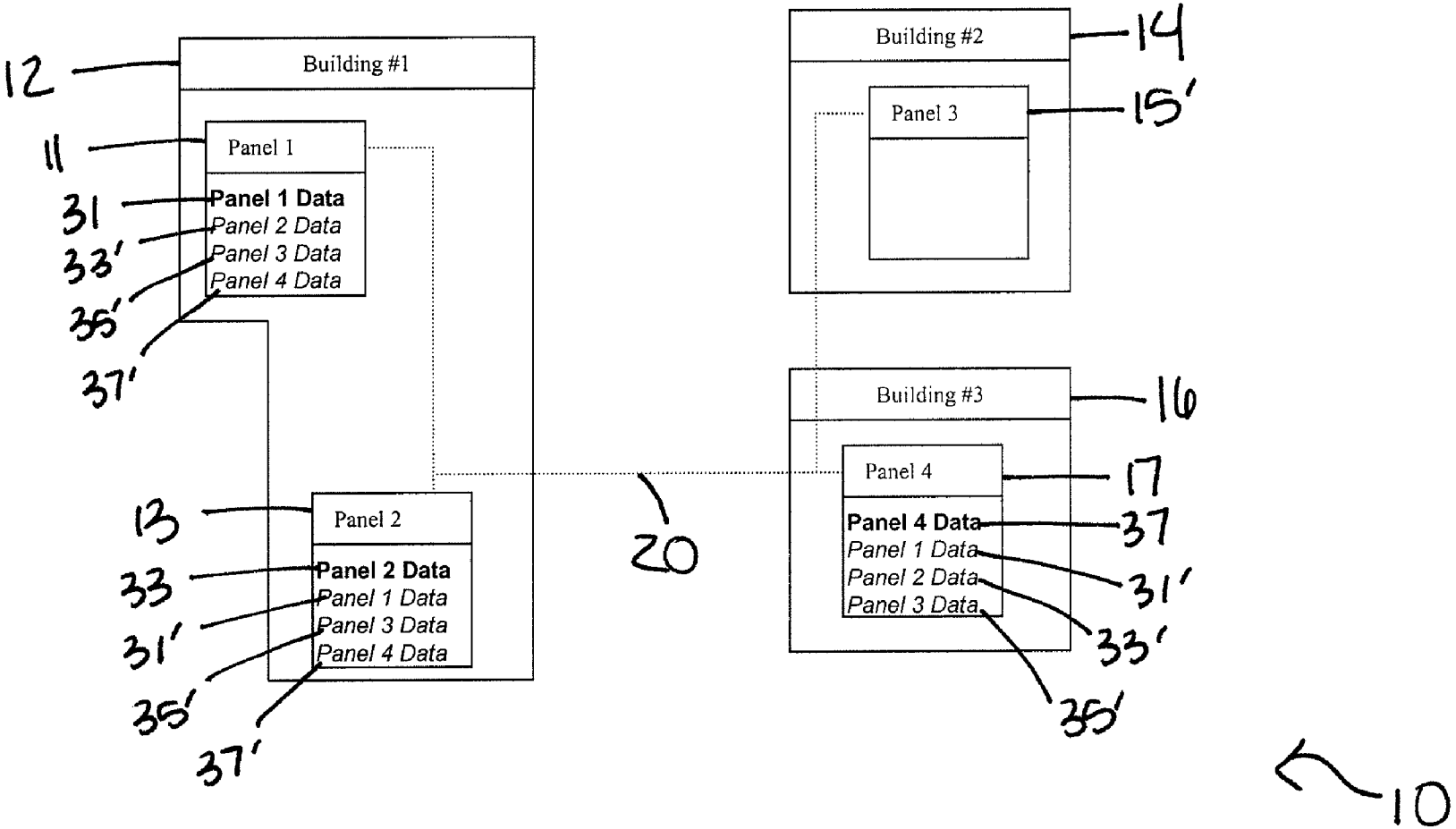

Alternatively, the implicit data backup system illustrated in FIG. 4 can continue until the embodiment illustrated in FIG. 5 in which each unit 11, 13, 15, 17 has backup copies 31', 33', 35', 37' of the configuration data 31, 33, 35, 37 for every other unit 11, 13, 15, 17 within the network 10. That is, the implicit data backup system can continue until unit 11 has backup copies 33', 35', 37' of the configuration data 33, 35, 37 of units 13, 15, 17; unit 13 has backup copies 31', 35', 37' of the configuration data 31, 35, 37 of units 11, 15, 17; unit 15 has backup copies 31', 33', 37' of configuration data 31, 33, 37 of units 11, 13, 17; and unit 17 has backup copies 31', 33', 35' of configuration data 31, 33, 35 of units 11, 13, 15.

FIG. 6 illustrates a fire detection network in accordance with the present invention in which a replacement unit has been installed. As can be seen in FIG. 6, a replacement unit 15' can be installed into the network 10. When the replacement unit 15' is initially installed into the network, it does not contain any configuration data or operation parameters. Once the installation of the replacement unit 15' is complete and power is applied to the unit 15', the surviving units 11, 13, 17 in the network 10 can begin communicating with the replacement unit 15' via the communication media 20.

An installer or technician can use a graphical user interface 120, as seen in FIG. 9, that is on or associated with any detection unit within the network 10 to direct the system to transfer backup configuration data 35' associated with the replacement unit 15' to the replacement unit 15'.

Figure 7:
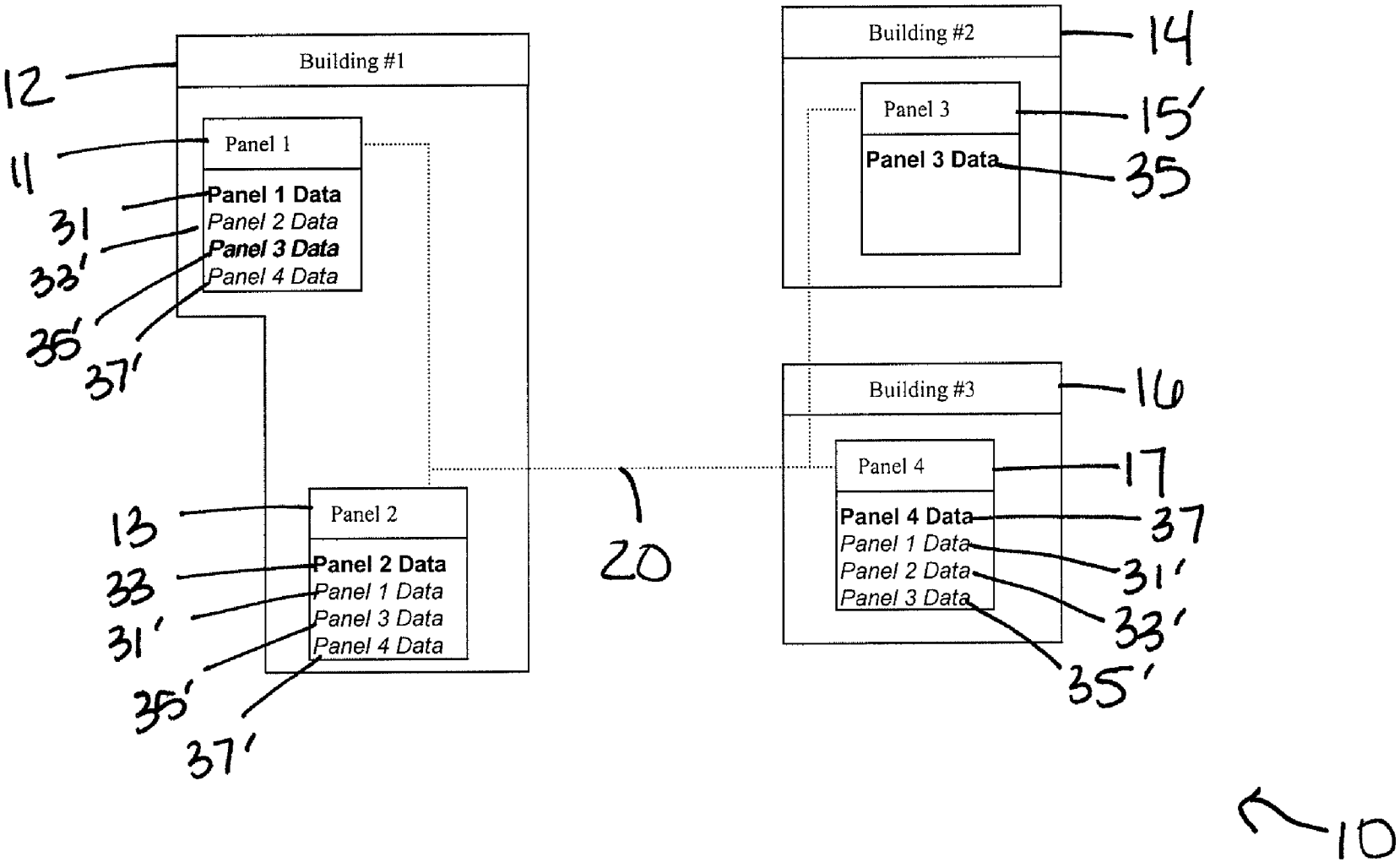
FIG. 7 illustrates a fire detection network in accordance with the present invention in which a replacement unit has received its configuration data.

FIG. 7 illustrates a fire detection network in accordance with the present invention in which a replacement unit has received its configuration data. As can be seen in FIG. 7, after the surviving units 11, 13, 17 begin communicating with the replacement unit 15', the replacement unit 15' can receive and store its configuration data 35.

In embodiments of the present invention where at least one other unit has backup copy of the configuration data for each unit within the network, the replacement unit 15' can receive its configuration data 35 from the unit 11, 13, or 17 storing the backup copy 35'. After the replacement unit 15' has received its own configuration data 35, then the replacement unit 15' can receive and store a backup copy of the configuration data of at least one other unit within the network.

Figure 8:
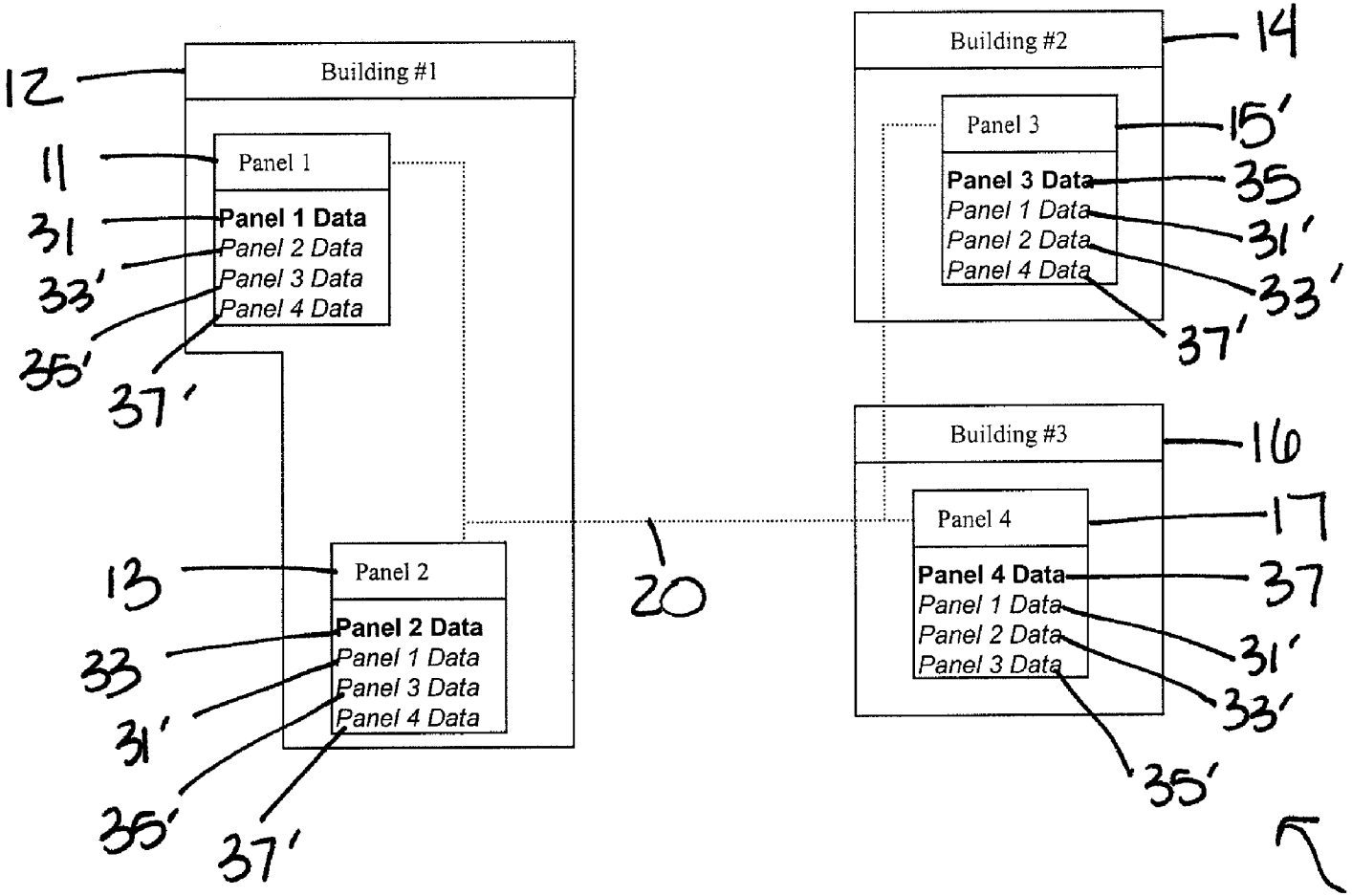
FIG. 8 illustrates a fire detection network in accordance with the present invention in which a replacement panel has received its configuration data and backup copies of the configuration data of all of the other units within the network.

In embodiments of the present invention where each unit has backup copies of the configuration data for every other unit within the network, the replacement unit 15' can receive its configuration data 35 from any other unit 11, 13, or 17 within the network 10. After the replacement unit 15' has received its own configuration data 35, then, as seen in FIG. 8, the replacement unit 15' can receive and store a back up copy 31', 33', 37' of the configuration data 31, 33, 37 of all of the other units 31, 33, 37 within the network 10.

What is claimed is:

1. A fire detection network comprising:

at least two fire detection units;

control circuitry associated with the first of the at least two fire detection units;

control circuitry associated with the second of the at least two fire detection units;

configuration data associated with the first of the at least two fire detection units, the configuration data associated with the first of the at least two fire detection units stored in the control circuitry associated with the first of the at least two fire detection units;

configuration data associated with the second of the at least two fire detection units, the configuration data associated with the second of the at least two fire detection units stored in the control circuitry associated with the second of the at least two fire detection units; and communication media coupling the at least two fire detection units together, wherein the control circuitry of the second of the at least two fire detection units transfers a backup copy of the configuration data associated with the second of the at least two fire detection units to the first of the at least two fire detection units and the control circuitry of the first of the at least two fire detection units stores the backup copy of the configuration data associated with the second of the at least two fire detection units, and wherein the control circuitry of the first of the at least two fire detection units transfers a backup copy of the configuration data associated with the first of the at least two fire detection units to the second of the at least two fire detection units and the control circuitry of the second of the at least two fire detection units stores the backup copy of the configuration data associated with the first of the at least two fire detection units.

2. The fire detection network as in claim 1 wherein the configuration data associated with the first and the second of the at least two fire detection units is downloaded to the at least two fire detection units from a personal computer and stored on a computer readable medium.

3. The fire detection network as in claim 2 wherein the personal computer is coupled to the first and the second of the at least two fire detection units individually.

4. The fire detection network as in claim 2 wherein the personal computer is coupled to either the first or the second of the at least two fire detection unit.

5. The fire detection network as in claim 1 wherein the backup copy of the configuration data associated with the first of the at least two fire detection units and the backup copy of the configuration data associated with the second of the at least two fire detection units are stored in a compressed format on a computer readable.

6. The fire detection network as in claim 1 wherein the control circuitry associated with the at least two fire detection units comprises a programmable processor and associated software.

7. The fire detection network as in claim 1 further comprising a graphical user interface associated with at least one of the at least two fire detection units.

8. The fire detection network as in claim 1 wherein the communication media is at least in part one of wired or wireless.

9. A fire detection network comprising:

at least one existing fire detection unit;

at least one replacement fire detection unit;

control circuitry associated with the at least one existing fire detection unit;

control circuitry associated with the at least one replacement fire detection unit;

configuration data associated with the at least one existing fire detection unit, the configuration data stored in the control circuitry of the at least one existing fire detection unit;

a backup copy of configuration data associated with the replacement fire detection unit, the backup copy stored in the control circuitry of the at least one existing fire detection unit;

a graphical user interface associated with at least one of the existing fire detection unit or the replacement fire detection unit; and communication media connecting the at least one existing fire detection unit and the at least one replacement fire detection unit, wherein the control circuitry of the at least one existing fire detection unit transfers the backup copy of the configuration data associated with the replacement fire detection unit and a backup copy of the configuration data associated with the at least one existing fire detection unit to the at least one replacement unit, wherein the control circuitry of the at least one replacement fire detection unit stores the backup copy of the configuration data associated with the replacement fire detection unit and the backup copy of the configuration data associated with the at least one existing fire detection unit in the control circuitry associated with the at least one replacement unit, and wherein the graphical user interface controls the transfer of the backup copy of the configuration data associated with the replacement fire detection unit and a backup copy of the configuration data associated with the at least one existing fire detection unit.

10. The fire detection network as in claim 9 wherein the backup copy of configuration data associated with the replacement fire detection unit and the backup copy of the configuration data associated with the at least one existing fire detection unit are stored in a compressed format on a computer readable medium.

11. The fire detection network as in claim 9 wherein the communication media is at least in part one of wired or wireless.

12. A method of backing up and recovering configuration data in a fire detection network comprising:

downloading configuration data onto at least two fire detection units;

storing configuration data associated with a first of the at least two fire detection units in control circuitry associated with the first of the at least two fire detection units;

storing configuration data associated with a second of the at least two fire detection units in control circuitry associated with the second of the at least two fire detection units;

transferring a backup copy of the configuration data associated the first of the at least two fire detection units to the second of the at least two fire detection networks;

transferring a backup copy of the configuration data associated with the second of the at least two fire detection units to the first of the at least two fire detection networks;

replacing the second of the at least two fire detection units with a replacement fire detection unit;

transferring the backup copy of the configuration data associated with the second of the at least two fire detection units to the replacement unit; and transferring the backup copy of the configuration data associated with the first of the at least two fire detection units to the replacement unit.

13. The method of claim 12 wherein the backup copy of the configuration data associated with the first of the at least two fire detection units and the backup copy of the configuration data associated with the second of the at least two fire detection units are stored in a compressed format on a computer readable medium.

14. The method of claim 12 wherein transferring the backup copy of the configuration data associated with the first of the at least two fire detection units and transferring the backup copy of the configuration data associated with the second of the at least two fire detection units are controlled by control circuitry located within the first and the second of the at least two fire detection units.

15. The method of claim 12 with the backup copy of the configuration data associated with the second of the at least two fire detection units transferred to the replacement unit functioning as configuration data for the replacement unit.

16. The method of claim 12 wherein transferring the backup copy of the configuration data associated with the second of the at least two fire detection units to the replacement unit and transferring the backup copy of the configuration data associated with the first of the at least two fire detection units to the replacement unit is controlled by a graphical user interface on or associated with at least one of the second of the at least two fire detection units or the replacement unit.

17. The method of claim 16 wherein transferring the backup copy of the configuration data associated with the second of the at least two fire detection units to the replacement unit and transferring the backup copy of the configuration data associated with the first of the at least two fire detection units to the replacement unit is executed by the control circuitry associated with the second of the at least two fire detection units and control circuitry associated with the replacement unit.

18. The method of claim 12 further comprising performing fire detection functions substantially simultaneously with transferring the backup copies of the configuration data associated with the at least two fire detection units.

19. The method of claim 12 wherein transferring the backup copies of the configuration data associated with the at least two fire detection units occurs over a communication media.

20. The method of claim 19 wherein the communication media is at least in part one of wired or wireless.

* * * * *